United States Patent [19]

Jones

[11] Patent Number: 4,714,436

[45] Date of Patent: Dec. 22, 1987

[54] TEST CLIP WITH GROUNDING ADAPTOR FOR CABLE CONNECTOR

[75] Inventor: Wayne R. Jones, Alderwood Manor, Wash.

[73] Assignee: John Fluke Mfg. Co., Inc., Everett, Wash.

[21] Appl. No.: 942,533

[22] Filed: Dec. 15, 1986

[51] Int. Cl.[4] ..... H01R 4/66; H01R 9/07

[52] U.S. Cl. ..... 439/497; 439/711

[58] Field of Search ..... 439/711, 713, 482, 607, 439/610, 494, 497

[56] References Cited

U.S. PATENT DOCUMENTS 3,914,007 10/1975 Seidler ..... 439/711

4,027,941 6/1977 Narozny ..... 439/497 X 4,508,403 4/1985 Weltman et al. ..... 439/494 X

*Primary Examiner*—Eugene F. Desmond

*Attorney, Agent, or Firm*—Stephen A. Becker

[57] ABSTRACT

A test clip and grounding adapter assembly comprises a conventional integrated circuit test clip of a type having parallel arrays of signal conductors retained in a pair of molded plastic arms biased closed on the leads of a unit under test.

An adaptor in accordance with the invention having twice as many conductors as the test clip interconnects the test clip and a ribbon cable. The additional conductors within the adaptor interposed with the signal conductors in the clip are grounded to electrically shield the signal wires.

18 Claims, 7 Drawing Figures

TEST CLIP WITH GROUNDING ADAPTOR FOR CABLE CONNECTOR

TECHNICAL FIELD

The present invention relates generally to test clips for printed circuit mounted integrated circuits or other units, and more particularly, to a novel adaptor for such test clips which electrically shields signal wires in ribbon cable interconnecting the clips and external test instrumentation.

BACKGROUND OF THE INVENTION

To electrically test printed circuit mounted integrated circuits or other devices, termed hereinafter "units under test", or "UUTs", external test instrumentation is connected to the leads of the UUT via an electrical cable, typically ribbon type cable, and a conventional test clip of a type described in U.S. Pat. No. 3,914,007. The test clip comprises an array of contact pins located within parallel channels of a pair of molded support arms. The two arms, pivotally connected to each other, are spring biased closed to grip a UUT with the pins of the clip in electrical contact with the leads of the UUT. The contact pins extend outward somewhat from the tops of the test clip arms to enable access to the pins for electrical contact. A ribbon cable, which is a flat array of parallel, closely aligned wires, carries electrical test signals between the UUT and the external instrumentation. A conventional ribbon cable socket interconnects the individual wires of the cable and the test clip by slipping onto the contact pins extending out the tops of the two arms.

During a test, high frequency test signals are exchanged between the UUT and the external test instrumentation through the ribbon cable and test clip. BEcause the wires of the ribbon cable are immediately adjacent each other, however, there is electrical coupling or "crosstalk" between signal lines which tends to interfere with the reliability of the test. There accordingly exists a need to electrically isolate or shield adjacent wires of a test clip and ribbon cable assembly from each other to avoid signal crosstalk and thereby improve the reliability of the test.

SUMMARY OF THE INVENTION

Accordingly, it is a primary object of the present invention to provide a test clip connected to a cable having provisios for shielding signals in adjacent wires in the cable from interfering with one another.

Another object is to bus together, at a test clip, all of the ground wires in a cable and connect these bussed grounds to the ground of a unit under test.

Another object is to provide an adapter for a conventional integrated circuit test clip which electrically shields adjacent wires of wires extending therefrom.

A further object of the invention is to provide an adapter for a conventional integrated circuit test clip and ribbon cable assembly for electrically shielding adjacent wires of the cable from each other.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved and novel connector and grounding adapter assembly is provided for connecting a plurality of leads under test to a testing apparatus by way of a cable. In its broadest aspect, the novel assembly includes a plurality of testing conductors, an arm for supporting the testing conductors, and a grounding pin adaptor supported by the arm and adapted to connect with a cable connector. The grounding pin adaptor, which includes a plurality of grounding pin conductors commonly bussed on a bus bar, connects the testing conductors to the cable connector.

In a preferred embodiment, the test clip has two hinged arms biased closed by a biasing spring. Each testing conductor includes a contact end for contacting a lead of the UUT and also includes a connector end for connecting to a cable connector attached to a cable from the testing apparatus. The cable connector preferably has two rows of connecting elements and is preferably connected to a flat ribbon cable. The first row of plural connecting elements and the second row or plural connecting elements are connected to alternate conductors in the flat ribbon cable. When the testing conductors are connected with the first row of connecting elements of the two row connector, the grounding pin conductors are preferably connected to the second row of connecting elements of the two row connector.

With this alternating arrangement of cable connector connecting elements and the conductors of the flat ribbon cable in accordance with the invention, the grounding potential on the gorunding pins of the adaptor appears on alternate conductors in the ribbon cable with respect to the conductors in the ribbon cable which carry the signals from the testing conductors. In other words, the cable conductors carrying test signals are separated from one another by interposed cable conductors carrying grounding potential. In this way, the signals from the testing conductors in the ribbon cable are shielded from one another by the intervening ground potential conductors.

In a further aspect of the invention, in accordance with its objects and purposes, an adaptor is provided for connecting acable connector attached to a cable to a removable two-armed test clip having a plurality of conductors. In the test clip, each of the clip conductors has a contact end for contacting a conductor on a UUT and has a connector end for connecting to the cable connector. The adaptor, in accordance with the invention, includes a top portion, a plurality of grounding pins bussed together on a bus bar and secured to the underside of the top portion, and two side portios extending downwardly from the top portion wherein each of the side portions has a flange for sliding engagement with one of the arms of the test clip.

In the preferred configuration of the adaptor, the grounding pins of the adaptor have an offset to provide a clearance to facilitate attachment of the cable connector to the grounding pins. The rear end of the top portion of the adaptor preferably covers the connection between the grounding pins and the cable connector thereby protecting the connection from damage. Also, preferably, the front ends of the side portions extend forwardly and downwardly from the top portion and provide reinforcement to the side portions when the adaptor is used to oppose the spring bias in the connector clip.

Preferably, the grounding pins of the adaptor are commonly bussed on a one-piece metal bus bar. Also, preferably, at least one additional connector extends from the bus bar and is adapted to connect with a connector for a grounding probe.

The top portion of the adaptor also serves as a gripping surface for a thumb or finger of the user when the adaptor is in position on the test clip.

Another feature of the adaptor of the invention is that complementary tongues and grooves may be provided for guiding the adaptor onto the arm of the test clip. More specifically, complementary tongues and grooves may be provided on the upper surface of a test clip arm and on the underside of the top portion of the adaptor.

Still other objects of the present invention will become readily apparent to those skilled in this art from the following descriptioi, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention.

DETAILED DESCRIPTION OF A PREFERRED EMBODIMENT OF THE INVENTION

Figure 1:
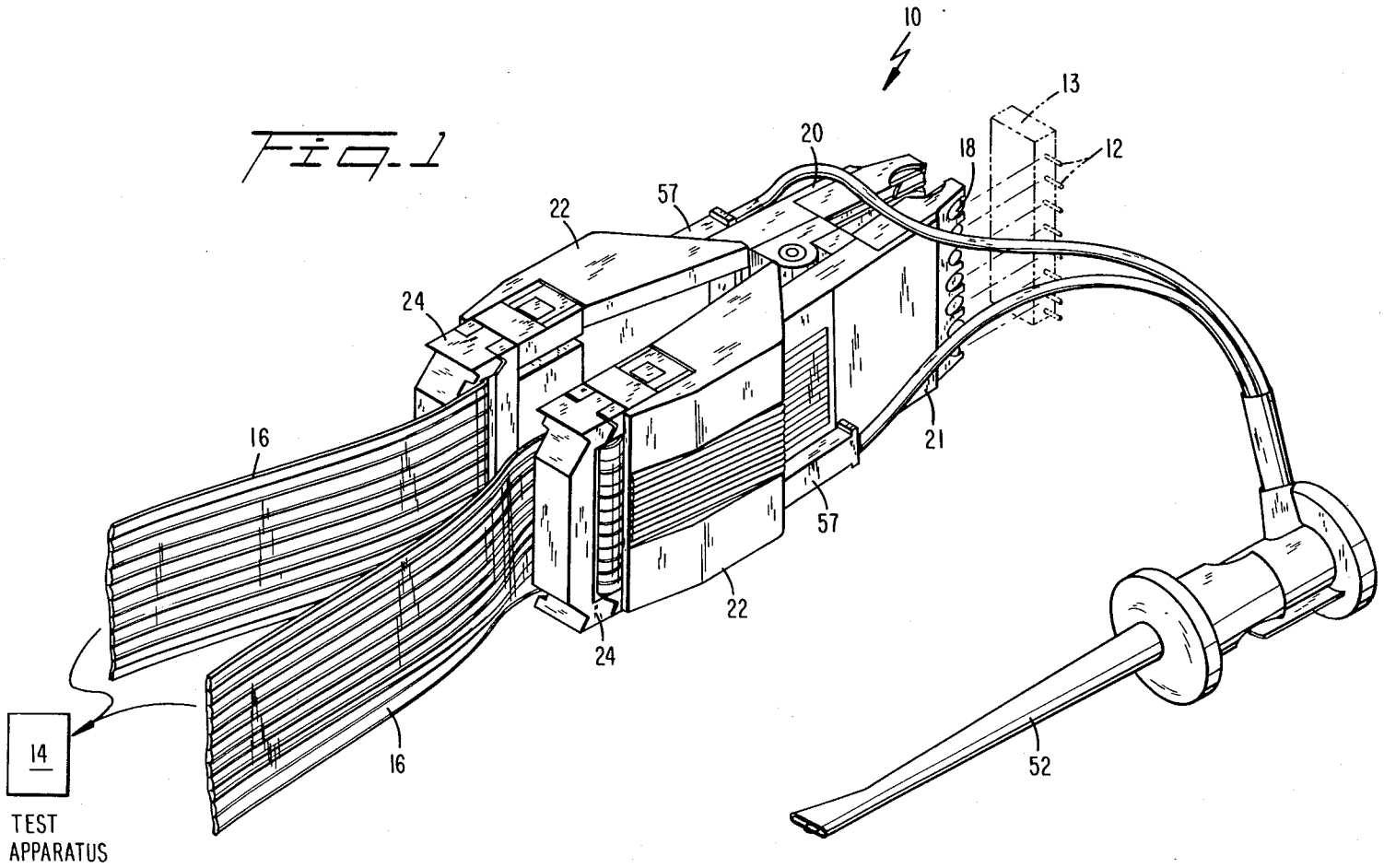
FIG. 1 is a perspective view of an integrated circuit test clip with two grounding pin adapters made in accordance with the invention.

With reference to the drawings, and more particularly to FIG. 1, there is disclosed a preferred embodiment of the test clip 10 and novel adaptor 22 of the present invention. In accordance with the invention, a conventional test clip 10 during a test interconnects a plurality of leads 12 of a UUT 13 which normally is mounted on a printed circuit board (not shown) to a testing apparatus 14 of any known type by way of a cable 16. In its broadest aspect, the test clip 10, which is generally of a type described in U.S. Pat. No. 3,914,007, includes a plurality of testing conductors 18 retained within corresponding channels molded in a pair of plastic arms 20, 21 as well as a grounding pin adaptor 22 in accordance with the invention, supported by the arm 20 and provided to connect with a standard cable connector 24.

Figures 2, 3:
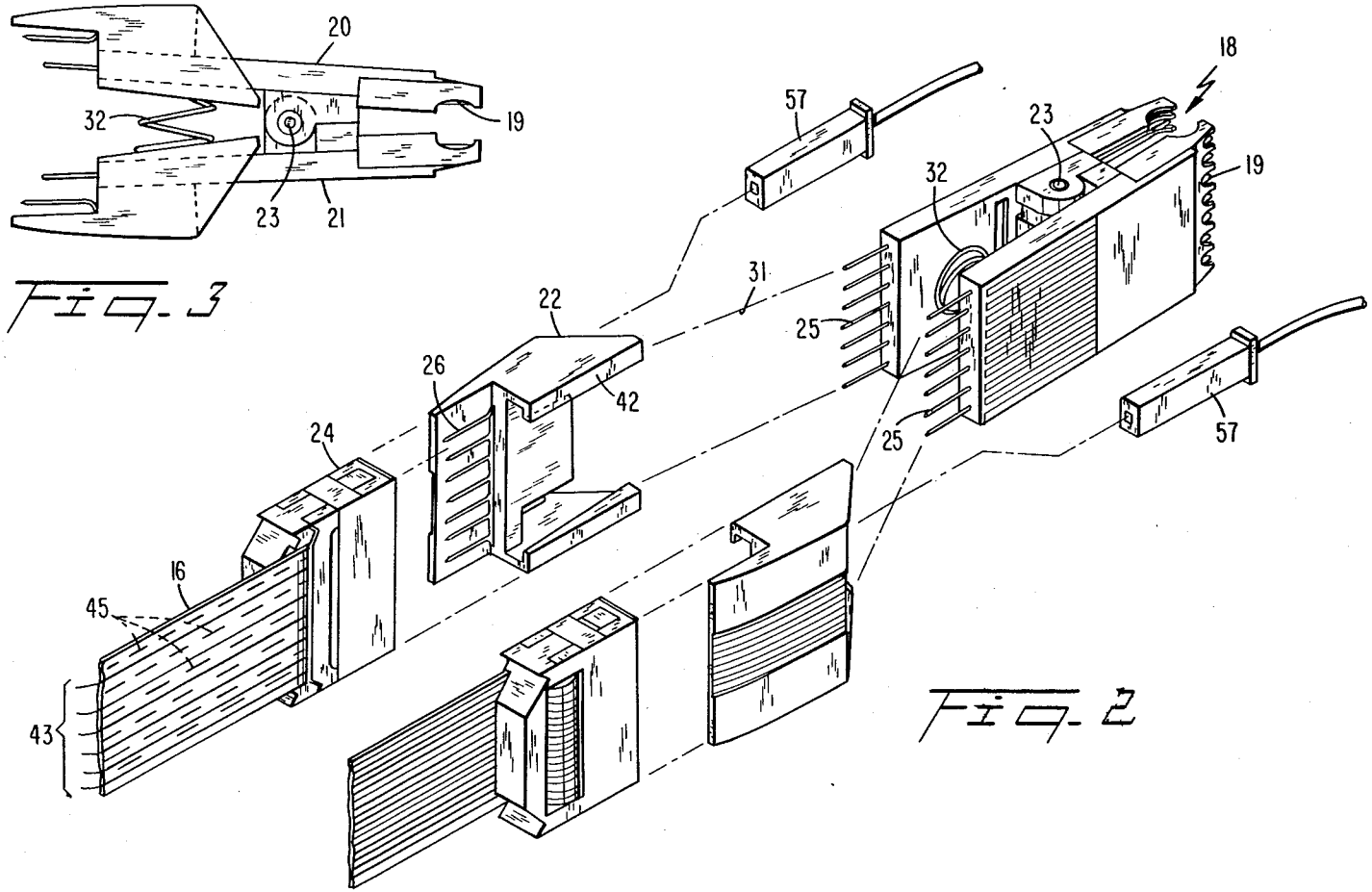
FIG. 2 is an exploded view of the embodiment of the invention shown in FIG. 1.
FIG. 3 is a side view of a test clip with two grounding pin adapters made in accordance with the invention.
Figure 4A:
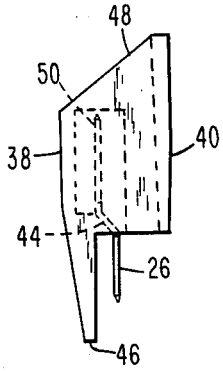
FIG. 4A is a side view of a grounding pin adaptor made in accordance with the invention.
Figure 4B:
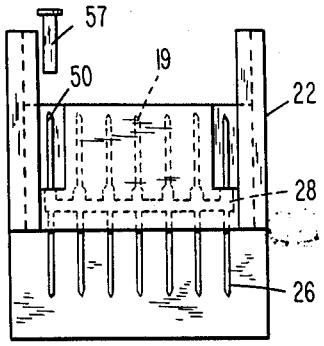
FIG. 4B is a front view of the grounding pin adaptor shown in FIG. 4A.

As shown in FIGS. 2 and 4B, the grounding pin adaptor 22 includes a plurality of grounding pin conductors 26 commonly bussed on a bar 28, with the adaptor connecting the testing conductors 18 of the clip arms to the cable connector 24. The two arms 20, 21 are mounted on a common pivot pin 23 and are urged closed by a spring 32, as shown in FIG. 3.

Figure 5:
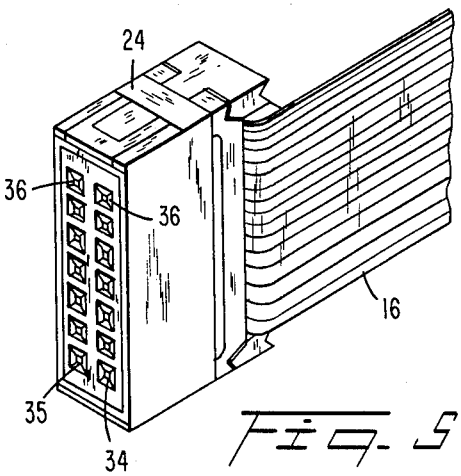
FIG. 5 is a perspective view of a dual row connector and ribbon cable assembly that can be used with a test clip and grounding pin adaptor made in accordance with the invention.

Each testing conductor 18 includes a contact end 19 (FIG. 2) for contacting a lead 12 of UUT 13 and also includes a connector end 25 for connecting to a cable connector 24 attched to the cable 16 from the testing apparatus 14. As shown in FIG. 5, the cable connector 24 preferably has two rows 34 and 35 of connecting elements 36 and cable 16 to which the connector is connected preferably is a flat ribbon cable.

The first and second rows 34 and 35 of plural connecting elements 36 are connected alternately to the conductors 43 and 45 in the flat ribbon cable 16 as shown in FIG. 2. When the testing conductors 18 are connected with the first row 34 of connecting elements 36 of the two row cable connector 24 and, correspondingly, to conductors 45, the grounding pin conductors 26 are preferably connected to the second row 35 of connecting elements 36 of the two row connector and, correspondingly, to conductors 43.

With this alternating arrangement of cable connector connecting elements 36 to the respective conductors 43 and 45 of the flat ribbon cable 16 in accordance with the invention, the grounding potential on the grounding pins 26 of the adaptor 22 appears on alternate conductors 43 in the ribbon cable 16 with respect to the conductors 45 in the cable which carry the signals from the testing conductors 18. In other words, the cable conductors 45 carrying test signals are separated from one another by interposed cable conductors 43 carrying ground potential. In this way, the signals from the testing conductor 18 in the ribbon cable 16 are shielded from one another by the intervening ground potential conductors.

Figure 4C:
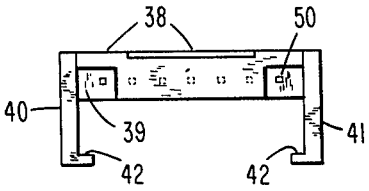
FIG. 4C is an end view of the grounding pin adaptor shown in FIG. 4A.

The adaptor 22 according to the invention, as further illustrated in FIGS. 4A, 4B, and 4C, includes a top portion 38, a plurality of grounding pins 26 bussed together on a one-piece bus bar 28 and secured to the underside 39 of the top portion 38, and two sides portions 40 and 41 extending downwardly from the top portion 38 wherein each of the side portions 40 and 41 has a flange 42 for sliding engagement with one of the arms 20 and 21 of the test clip 30. In FIG. 2, the connecting line 31 shows the pathway for connecting the adaptor 22 with the arm 20 of the test clip 30.

In the preferred configuration of the adaptor 22, the grounding pins 26 have an offset 44 (FIG. 4A) to provide a clearance to facilitate attachment of the cable connector 24 to the grounding pins 26. The rear end 46 of the top portion 38 of the adaptor 22 preferably covers the connection between the grounding pins 26 and the cable connector 24. Also, preferably, the front ends 48 of the side portions 40 and 41 extend forwardly and downwardly from the top portions 40 and 41 when the adaptor 22 is sued to oppose the spring bias in the connector clip for opening the clip.

Preferably, the grounding pins 26 of the adaptor 22 are commonly bussed on a one-piece metal bus bar 28, as shown in FIG. 4B. Also, preferably, at least one additional pin 50 extends from the bus bar 28 and is adapted to connect with a connector 57 for a grounding clip 52 (FIG. 1).

The portion 38 of the adaptor 22 serves as a gripping surface for a thumb or finger of the user when the adaptor 22 is in position on the test clip 10.

In summary, numerous benefits have been described which result from employing the principles of the invention. A grounding pin adaptor made in accordance with the invention permits connecting a single row of signal leads of a UUT from an attached test clip to the first row of contacts of a dual row connector attached to a flat ribbon cable. A grounding pin adaptor made in accordance with the invention busses together the second row of contacts of a standard dual row connector. The second row of contacts of the dual row connector terminates alternate conductors of a flat ribbon cable and thereby maintaines every other conductor in the flat ribbon cable at a common potential, such as ground potential, at the end of the cable connected to the test clip. In this way, signal lines are shielded from interfering from one another by the intervening grounded lines. The grounding pin adaptor made in accordance with the invention provides protection to the connection between the leads of the test clip and the dual row connector. It protects the connection from harmful pressure exerted by the operator to overcome the spring bias of the arms of the test clip. The grounding pin adaptor made in accordance with the invention in effect lengthens the arms of the test clip for better leverage thereby providing greater mechanical advantage and requiring less operator force to separate the jaws of the clip.

A grounding pin adaptor made in accordance with the invention allows an operator access to a ground connection at the test clip so that a clip can be used in conjunction with the adaptor.

The foregoing description of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A connector for connecting a plurality of leads of a unit under test (UUT) to a testing apparatus through an interface cable, said connector, comprising:

a plurality of test conductors, each test conductor having a contact end for contacting a lead under test and a connector end for connecting to said cable;

first arm means for supporting said test conductors; and reference voltage pin adaptor means comprising a plurality of commonly bussed pins and means for attaching said adaptor means to said first arm means.

2. A connector as described in claim 1, wherein said plurality of commonly bussed pins are integrally formed.

3. A connector as described in claim 1, wherein:

said cable is terminated by a two row connector;

said plurality of cable connector ends are adapted to connect with the first row of plural connectors in said two row connector;

said plurality of grounding pins are adapted to connecti with the second row of plural connectors in said two row connector; and the two row connector is connected to a flat ribbon cable whereby the first row of plural connectors and the second row of plural connectors are connected alternately to the conductors in the flat ribbon cable.

4. A connector as described in claim 1 wherein said means for attaching said adaptor means to said first arm means is removably attachable.

5. A connector as described in claim 4 wherein said removably attachable means for attaching said adaptor means to said first arm means includes flange means that slidingly engage said first arm means.

6. A connector as described in claim 1 wherein said reference voltage pin adaptor means has a rear portion which covers said pins.

7. A connector as described in claim 1 including a two row connector terminating said interface cable, and wherein said reference voltage pins have an offset to provide clearance for a two row connector.

8. A connector as described in claim 1 wherein said plurality of reference voltage pins further include a bus bar.

9. A connector as described in claim 1 wherein said plurality of reference voltage pins further comprise a bus bar and wherein at least one connector extends from said bus bar and is adapted to connect with a connector for a grounding probe.

10. A connector as described in claim 1, including a cable connector terminating said interface cable, said connector further comprising:

hinge means;

second arm means attached to said first arm means by said hinge means, said second arm means supporting a plurality of second test conductors, each of said second test conductors comprising a contact end for contacting a lead of said UUT and a connector end for connecting said cable connector; and spring means for biasing the contact ends of said first and second arm means towards each other.

11. An adaptor for connecting a cable connector attached to a cable to a removable two-armed connector clip having a plurality of conductors, each of said conductors having a contact end for contacting a conductor of a unit under test (UUT) and a connector end for connecting to the cable connector, said adaptor comprising:

a top portion;

a plurality of grounding pins bussed together on a bus bar and secured to an underside of said top portion;

two side portions extending downwardly from said top portion, each of said side portions having a flange for sliding engagement with one of the arms of the connector clip.

12. An adaptor as described in claim 11 wherein said grounding pins have an offset to provide an clearance to facilitate attachment of the cable connector to said grounding pins.

13. An adaptor as described in claim 11 wherein the rear end of said top portion covers the connection between said grounding pins and the cable connector.

14. An adaptor as described in claim 11 wherein the front ends of said side portions extend forwardly and downwardly from said top portion and provide reinforcement to said side portions when the adaptor is used to oppose the spring bias in the connector clip.

15. An adaptor as described in claim 11 wherein said top portion comprises a gripping means for a thumb or finger of a user of the adaptor.

16. An adaptor as described in claim 11 wherein said plurality of commonly bussed grounding pins are comprised of an integral metal piece.

17. An adaptor as described in claim 11, further comprising at least one connector which extends from said bus bar and which is adapted to connect with a grounding probe.

18. A connector for connecting a plurality of leads of a unit under test (UUT) to a testing apparatus through a two row cable connector to a cable, said connector, comprising:

a plurality of test conductors, each test conductor having a contact end for contacting a lead of the UUT and a connector end for connecting to said cable connector, said plurality of cable connector ends adapted to connect with the first row of plural connectors in said two row connector;

first arm means for supporting said test conductors;

removably attachable grounding pin adaptor means including a plurality of commonly bussed grounding pins, said plurality of grounding pins adapted to connect with the second row of plural connectors in said two row connector, said grounding pins being integral with a bus bar and having an offset to provide clearance for connection with said two row connector, wherein at least one connector extends from said bus bar and is adapted to connect with a connector for a grounding probe, said grounding pin adaptor means further including slidingly engageable flange means for attaching said adaptor means to said first arm means, said grounding pin adaptor means further comprising a rear portion which covers said grounding pins;

hinge means;

second arm means attached to said first arm means by said hinge means, said second arm means supporting a plurality of second test conductors, each of said second test conductors including a contact end for contacting a lead under test and a connector end for connecting to a cable connector attached to a cable from the test apparatus; and spring means for biasing the contact ends of said first and second arm means towards each other;

wherein the two row connector is connected to a flat ribbon cable whereby the first row of plural connectors and the second rwo of plural connectors are connected alternately with the conductors in the flat ribbon cable.

* * * * *